US005380000A

United States Patent [19]

Ohno

[11] Patent Number: 5,380,000

[45] Date of Patent: Jan. 10, 1995

[54] DELIVERY MACHINE OF FOLDER UNIT

[75] Inventor: Kinitiro Ohno, Machida, Japan

[73] Assignee: Tokyo Kikai Seisakusho, Ltd., Tokyo, Japan

[21] Appl. No.: 268,731

[22] Filed: Jun. 30, 1994

Related U.S. Application Data

[63] Continuation of Ser. No. 60,917, May 13, 1993, abandoned.

[30] Foreign Application Priority Data

Sep. 28, 1992 [JP] Japan ..... 4-281091

[51] Int. Cl.[6] ..... B65H 5/02; B65H 29/04

[52] U.S. Cl. ..... 271/277; 271/204; 198/803.9; 101/410

[58] Field of Search ..... 271/204, 206, 277; 101/408, 409, 410; 198/803.1, 803.7, 803.9

[56] References Cited

U.S. PATENT DOCUMENTS

| | | | |
|---|---|---|---|
| 3,841,625 | 10/1974 | Carricato | 271/206 X |
| 4,201,286 | 5/1980 | Meier | 271/277 X |
| 4,205,837 | 6/1980 | von Hein et al. . | |
| 4,982,944 | 1/1991 | Eberle | 271/277 X |
| 5,261,656 | 11/1993 | Gutov et al. | 271/204 X |

FOREIGN PATENT DOCUMENTS

| | | | |
|---|---|---|---|
| 1-54261 | 11/1989 | Japan . | |
| 1395527 | 5/1988 | U.S.S.R. | 271/277 |

*Primary Examiner*—Robert P. Olszewski
*Assistant Examiner*—Boris Milef
*Attorney, Agent, or Firm*—Armstrong, Westerman, Hattori, McLeland & Naughton

[57] ABSTRACT

A delivery machine of a folder unit including endless transfer means disposed to pass in close proximity to a downstream side of a discharge portion of a folding machine for discharging, one-by-one, folded paper sheets while passing around guide wheels driven in synchronism with the operation of the folding machine. The delivery machine also includes an openable/closable folded paper sheet holding device sequentially disposed on the endless transfer means with predetermined gaps between them. A folded paper sheet holding operation device brings the folded paper sheet holding device at least from an open state to a closed state in close proximity to the downstream side of the discharge portion of the folding machine so as to allow them to hold one-by-one the folded paper sheets discharged sequentially from the discharge portion of the folding machine. An attitude control device changes the attitude of the folded paper sheet holding device inside a predetermined transfer movement zone of the folded paper sheeting holding device.

2 Claims, 3 Drawing Sheets

DELIVERY MACHINE OF FOLDER UNIT

This application is a continuation of application Ser. No. 08/060,917 filed May 13, 1993, now abandoned.

BACKGROUND OF THE INVENTION:

1. Field of the Invention

This invention relates to a delivery machine for individually holding, by a large number of holding means, and discharging folded printed paper sheets that are folded and discharged by a folding machine of a rotary press.

2. Description of the Relates Art

The following delivery machines are known as delivery machines for individually holding, by a large number of holding means such as holding means of partial grip type gripping mechanisms, and discharging folded paper sheets of printed matters folded and discharged from a folding machine of a rotary press.

The delivery machine described in Japanese Patent Publication No. 54261/1989 combines delivery fans with stopper wheels having a different center of rotation from that of the delivery fans, and rotates the stopper wheels in the same rotating direction as the delivery fans but at a lower rotating speed than that of the delivery fans. The stopper wheel is equipped around its outer peripheral surface with a corresponding number of stoppers to the number of the delivery fans, and each stopper is provided with holding means. The folded paper sheet that falls from above and strikes the stopper is held by the holding means disposed at the stopper portion, and is then extruded and discharged from the delivery fan by the stopper.

U.S. Pat. No. 4,205,837 describes a construction wherein an endless chain having a gripper mechanism is disposed below the center of rotation of delivery fans, and the folded paper sheet falling to, and supported by, the delivery fans is held by the gripper mechanism and is discharged from the rotating delivery fans by chain circulation movement.

In the mechanism disclosed in Japanese Patent Publication No. 54261/1989 described above, the delivery fans have the different center of rotation from that of the stopper wheel. Therefore, the driving mechanism of the delivery fans becomes complicated, and the reduction of size and simplification of the construction of the machine are difficult to attain.

In the construction of the U.S. Pat. No. 4,205,837, on the other hand, the driving mechanism of the delivery fans is separate from the driving mechanism of a transfer apparatus using the gripper mechanism. Therefore, the reduction of the size and simplification of the construction of the machine are difficult to attain in the same way as in the Japanese patent described above.

When the folded paper sheet, which is held by the gripper mechanism inside the delivery fan, is discharged from the rotating delivery fan, it is difficult to discharge the folded paper sheet without damaging it, due to the structural relationship between the path of the rotating fans and the gripper mechanism so moving as to transversely cross the orbit.

SUMMARY OF THE INVENTION

A delivery machine of a folder unit according to the present invention comprises endless transfer means disposed to pass the proximity of a downstream side of a discharge portion of a folding machine for discharging folded paper sheets one-by-one, and passed around guide wheels driven in synchronism with the operation of the folding machine; openable/closable folded paper sheet holding means sequentially disposed on the endless transfer means with predetermined gaps between them; folded paper sheet holding operation means for bringing the folded paper sheet holding means at least from an open state to a closed statue in the proximity of the downstream side of the discharge portion of the folding machine to allow them to hold the folded paper sheets discharged sequentially from the discharge portion of the folding machine one-by-one; and attitude control means for changing the attitude of the folded paper sheet holding means inside a predetermined transfer movement zone of the folded paper sheet holding means.

The delivery machine of the present invention may further include delivery fans disposed with the same gap as that of the folded paper sheet holding means so that when the endless transfer means passes in the proximity of the downstream side of the discharge portion of the folding machine, the folded paper sheet holding means are positioned between the fans adjacent to one another, respectively; and delivery fan wheels rotating in such a manner that the delivery fans move with the folded paper sheet holding means.

According to the delivery machine of the folder unit, a travelling web of printed paper is cut and folded by the folding machine, and is sequentially discharged one-by-one as the folded paper sheets.

In the delivery machine of the folder unit positioned on the downstream side of the discharge portion of the folding machine, the endless transfer means travels through the guide wheels driven in synchronism with the operation of the folder unit, and the folded paper sheet holding means disposed on the endless transfer means sequentially pass the downstream side of the discharge portion of the folding machine. The folded paper sheet holding means under the open state receive one-by-one the folded paper sheets sequentially discharged, at the time of the passage, are then closed by the forded paper sheet holding operation means, and hold folded paper sheets.

With the travel of the endless transfer means, the folded paper sheet holding means move, and their attitude is changed to a suitable one for receiving and holding the folded paper sheets by the operation of the attitude control means within a predetermined zone inclusive of the holding operation of the folded paper sheet. As the folded paper sheet holding means further move and when they reach a suitable position, they are opened to release the folded paper sheet, and then travel once again to the downstream side of the discharge portion of the folding machine.

When the delivery fan wheels are provided, the adjacent delivery fans pass the downstream side of the discharge portion of the folding machine with the folded paper sheet holding means while keeping the positional relationship such that the folded paper sheet holding means are interposed between the adjacent delivery fans. Accordingly, the folded paper sheet holding means can reliably receive the discharged folded paper sheets.

The above and other objects, features and advantages of the present invention will become apparent from the following description when taken in conjunction with the accompanying drawings.

BRIEF DESCRIPTION OF THE DRAWINGS

The present invention is illustrated in the following drawings, in which.

DESCRIPTION OF THE PREFERRED EMBODIMENTS

A delivery machine of a folder unit according to a first embodiment of the present invention will be described with reference to the accompanying drawings.

Figure 1:
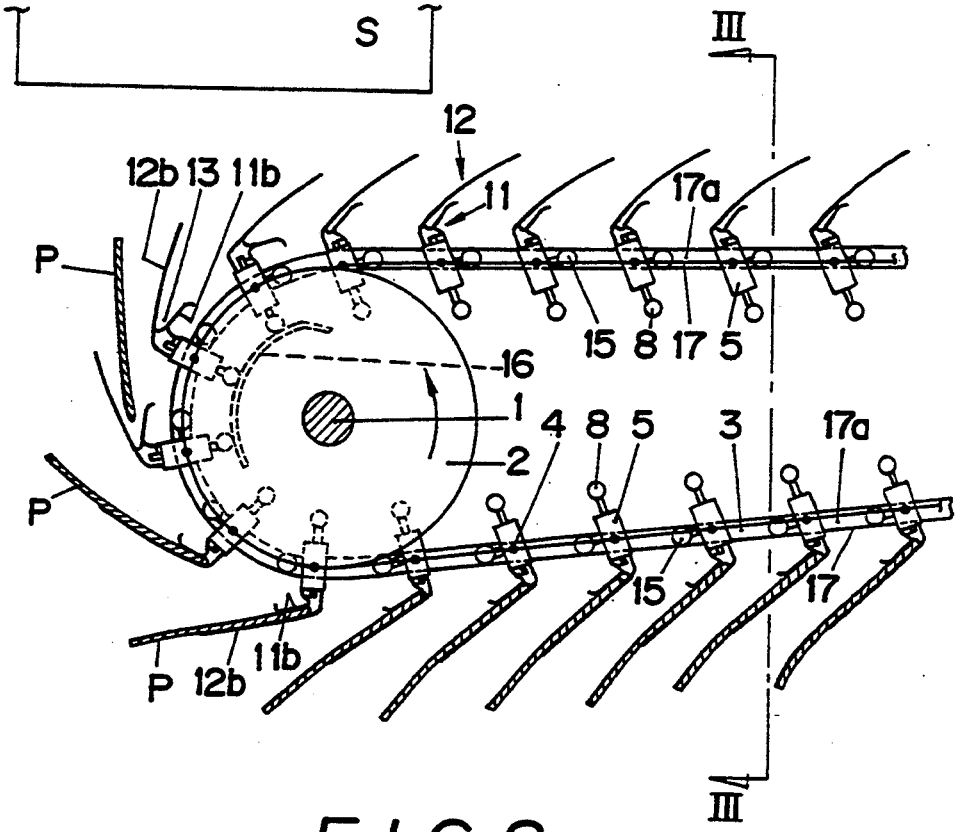
FIG. 1 is a structural view of a delivery machine of a folder unit according to the first embodiment of the present invention.
Figure 2:
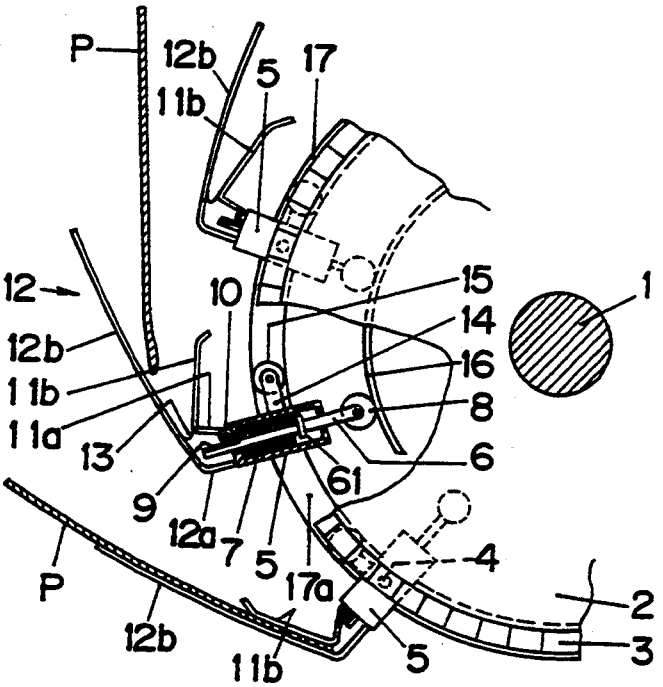
FIG. 2 is a partial sectional view of holding means of the delivery machine of the folder unit in the first embodiment of the present invention.
Figure 3:
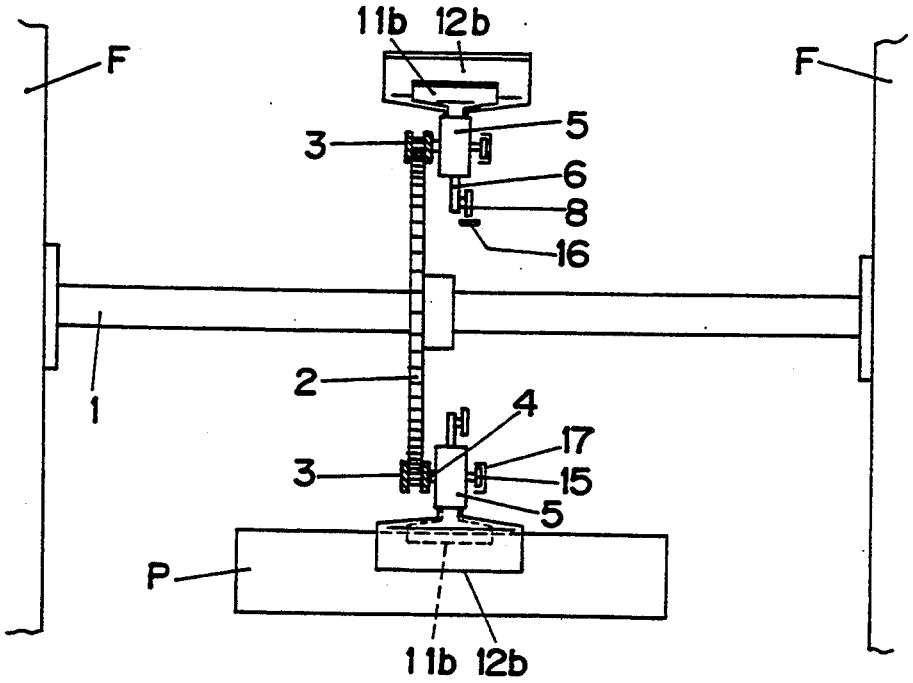
FIG. 3 is a sectional view taken along line III—III in FIG. 1.

The delivery machine of the folder unit according to the first embodiment which is shown in FIGS. 1 to 3 is disposed below a folding machine S so that it can receive folded paper sheets discharged from the folding machine S after a printed web of travelling paper (not shown) is folded and cut by the folding machine S of a rotary press.

A driving shaft 1 of the delivery machine is rotatably supported at both of its ends by machine frames F, F and is driven for rotation by a suitable driving source (not shown). A sprocket 2 having a boss portion is fixed to an intermediate part of this driving shaft i. An endless chain 3 is passed substantially horizontally around this sprocket 2 and another sprocket fixed to a rotary shaft which is similar to the driving shaft 1 and is not shown in the drawing. The external side of the sprocket 2 is positioned substantially immediately below a folded paper sheet discharge port of the folding machine S.

Pins 4 are implanted to the endless chain 3 to protrude sideways therefrom at a pitch capable of matching the folded sheet discharge pitch of the folding machines.

Ends of every suitable number of pins of the endless chain 3 may be allowed to protrude from a link with a suitable gap between them to work as the pins 4, or pins may be implanted either directly or indirectly to the link, so long as a predetermined pitch can be obtained.

A block 5 having the shape of a hollow cylinder or a box-like shape is rotatably supported at the tip of each pin 4. If the pin 4 itself is rotatable, the block 5 may be fixed to the pin 4.

Both ends of a sliding shaft 6 slidably penetrating through each block 5 in a longitudinal direction protrude out from the block 5, and has a flange 61 at the hollow portion of the block 5. A compression spring 7 is interposed between one of the end walls of the hollow portion of the block 5 and the flange 61.

The protruding end of the sliding shaft 6 is urged to protrude by the force of the compression spring 7 towards the center side of the sprocket 2, and a follower roller 8 is rotatably fitted to this protruding end. A rack 9 is threaded at the other protruding end.

A pinion 10 meshing with a rack 9 is rotatably fitted to the outer end portion of the block 5, and a proximal end 11*a* of a movable clamp plate 11, which is bent into a V-shape, is fixed to the outer peripheral surface of the pinion 10. A proximal end 12*a* of a stationary clamp plate 12, which is similarly bent into a V-shape, is fixed to the same end portion of the block 5 in such a :manner as to face the movable clamp plate 11. The clamp portions 11*b* and 12*b* of the movable and stationary clamp plates 11 and 12 on the distal side are inclined at a suitable angle with respect to the radial direction of the sprocket 2. The clamp portion 12*b* of the stationary clamp plate 12 is longer than the clamp portion 11*b* of the movable clamp plate 11 and supports the folded paper sheets from their back.

The gap between the clamp portion 12*b* of the movable clamp plate 11 and the clamp portion 12*b* of the stationary clamp plate 12 on the proximal side is closed by a flexible stopper plate 13 connected to both of them.

A follower roller 15 is rotatably fitted to the side surface of the block 5 through a bracket 14 functioning as a rocking arm as will be described elsewhere.

An arcuate guide plate 16 having a predetermined guide shape, with which the follower roller 8 meshes, is disposed at a predetermined position which is substantially concentric with the outer periphery of the sprocket 2, and is fitted to the machine frame F through a bracket, not shown. The follower roller 8 is brought into pressure contact with the guide plate 16 by the force of the compression spring 7 within the meshing zone with the guide plate 16. A guide rail 17 having U-shaped sectional shape defines a guide groove 17*a* of a predetermined guide shape for the engagement with the follower roller 15. It is disposed along the endless chain 3 and is likewise fitted to the machine frame F.

As will be described later, the guide shape of the guide plate 16 is determined in such a manner as to control opening and closing of the clamp portion 11*b* of the movable clamp plate 11 with respect to the clamp portion 12*b* of the stationary clamp plate 12, and the guide shape of the guide groove 17*a* restricts the turn up/down posture of the clamp portion 12*b* of the stationary clamp plate 12 by rocking the folded paper sheet holding means as a whole.

Figure 4:
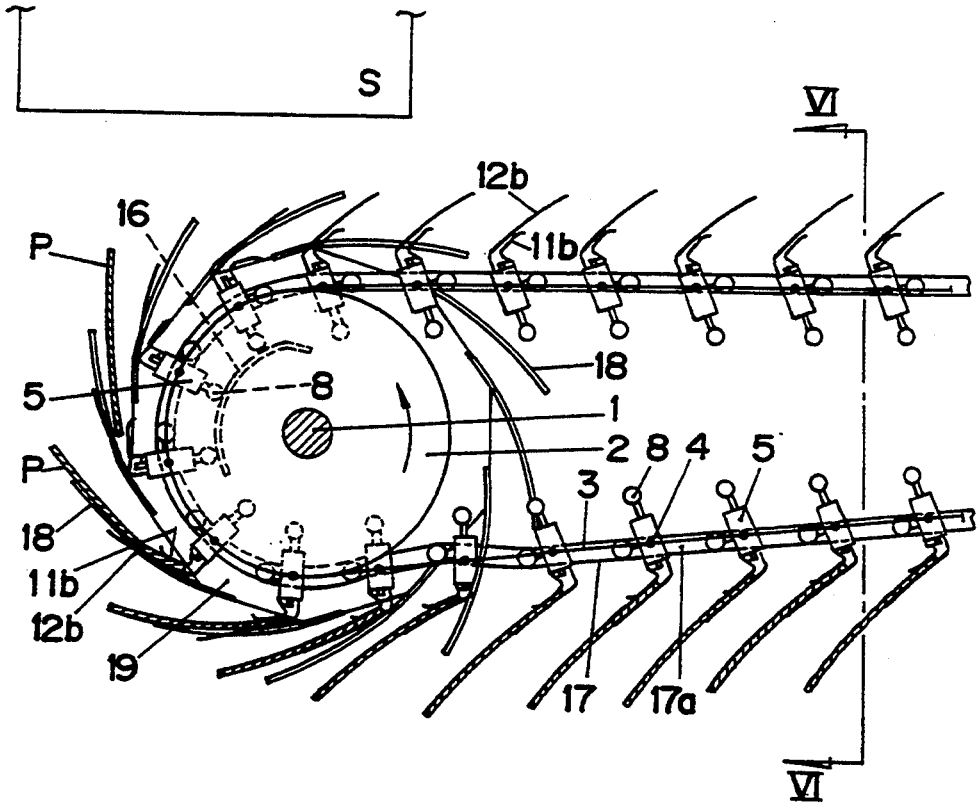
FIG. 4 is a structural view of a delivery machine of a folder unit according to the second embodiment of the present invention.
Figure 5:
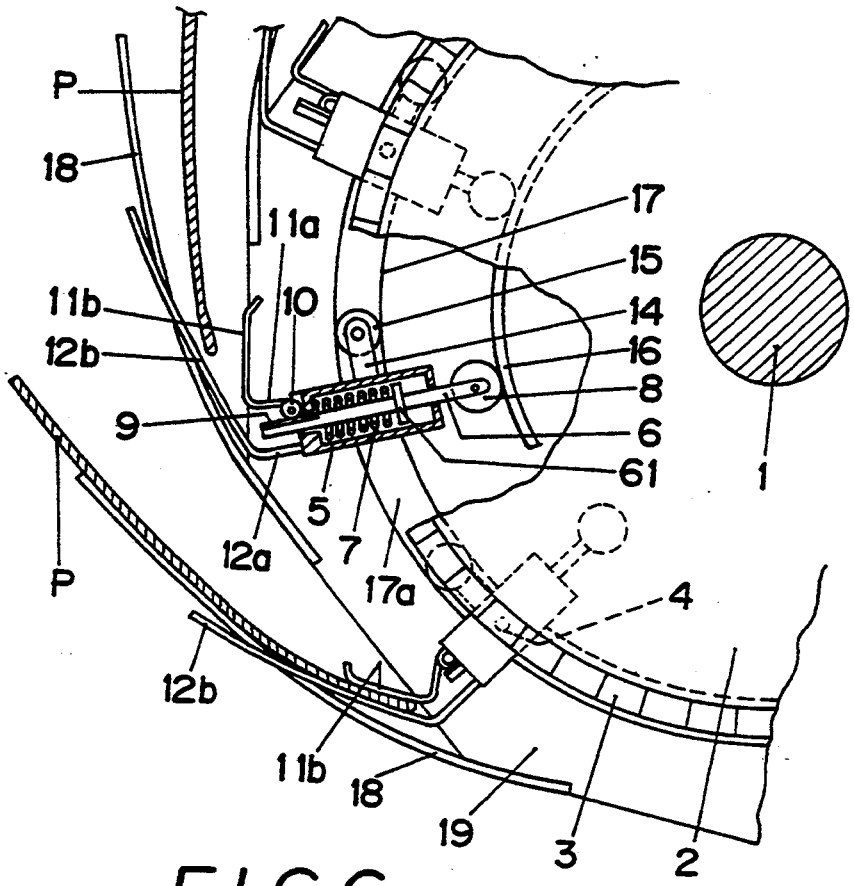
FIG. 5 is a partial sectional view of holding means of the delivery machine of the folder unit in the second embodiment of the present invention.
Figure 6:
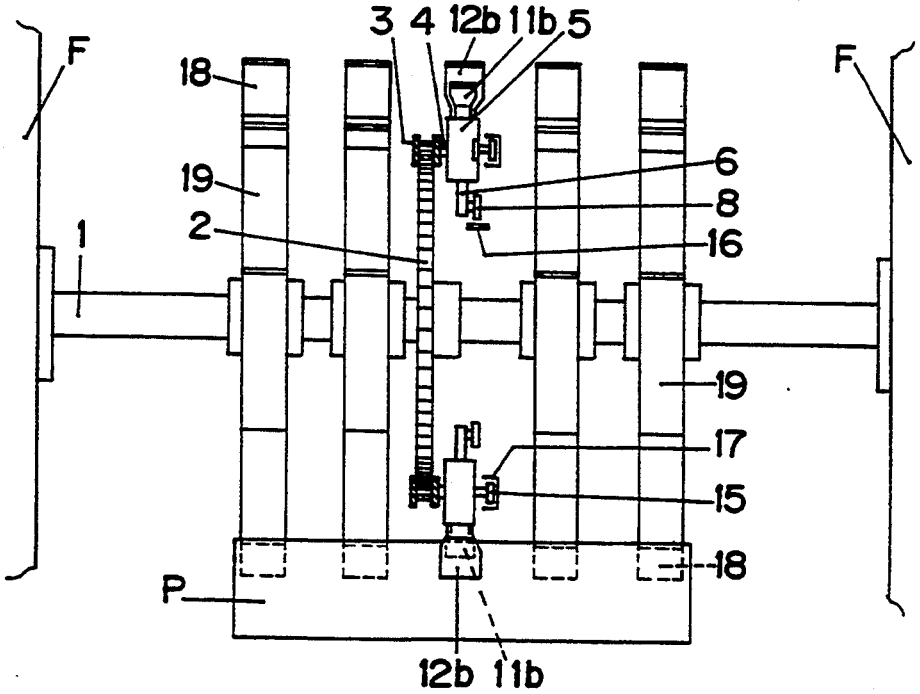
FIG. 6 is a sectional view taken along a line VI—VI in FIG. 4.

The delivery machine of the folder unit according to the second embodiment of the present invention is shown in FIGS. 4, 5 and 6. In this embodiment, a suitable number of delivery fan wheels 19 are fitted to the driving shaft 1 on both sides of the sprocket 2 (two each on both sides in the embodiment shown in the drawing) with predetermined gaps between them. Each of the delivery fan wheels 19 includes a suitable number of delivery fans 18 that are implanted equidistantly and radially to the outer periphery thereof.

More definitely, the proximal end portion of each delivery fan 18 curved into an arcuate shape is attached to each side of the delivery fan wheel 19 having the shape of a polygonal sheet, and the pitch of the clamp portions 12*b* of the stationary clamp plates 12 in the endless chain 3 meshing with the sprocket 2 has the same pitch as the pitch of the delivery fans 18. The clamp portions 12*b* are disposed substantially in superposition with the delivery fans 18 as viewed from the direction of arrow A in FIG. 6.

The V-shaped bottom defined between the side portions of the delivery fan wheels 19 and the delivery fans 18, as viewed in the axial direction, exists at a position substantially corresponding to the position of the stopper plate 13 in the first embodiment and plays substantially the same function as that of the stopper plate 13. In other words, the stopper plate 13 is omitted in this second embodiment.

Next, the operation of the delivery machine of the folder unit in each of the two embodiments will be explained. The printed web of travelling paper (not shown) is cut and folded by the folding machine S of the rotary press, and is sequentially discharged down one by one as the folded paper sheets P.

In the delivery machine positioned below the folding machine S, on the other hand, the driving shaft 1 is driven for rotation by the driving source (not shown), and the endless chain 3 is rotated counter-clockwise in FIGS. 1 and 4 due to the rotation of the sprocket 2. Consequently, each block 5 equipped with the movable clamp plate 11 and the stationary clamp plate 12, too, is rotated counter-clockwise. In this instance, when the block 5 exists in tile linear traveling zone (the upper left zone in FIGS. 1 and 4) of the endless chain 3, the follower roller 8 is not at all restricted. Accordingly, it protrudes due to the force of the compression spring 7 and the sliding shaft 6 is supported under the state where the rack 9 is moved back. Due to the position of the rotation of the pinion 10 at this time, the clamp portion 11*b* of the movable clamp plate 11 is under the closed state with respect to the clamp portion 12*b* of the stationary clamp plate 12.

The endless chain 3 is rotated by the sprocket 2 so that the travelling pitch of the blocks 5 equipped with the movable and stationary clamp plates 11, 12 is in synchronism with the discharge pitch of the folded paper sheets P.

The follower roller 15 undergoes displacement in substantially a perpendicular direction to the endless chain 3 in accordance with the shape of the guide groove 17*a*, while the bracket 14, that is, the stationary clamp plate 12 of the block S, undergoes rotating displacement round the pin 4 as the center. Accordingly, the turn-up/down attitude of the stationary clamp plate 12 to the endless chain 3 is restricted. Therefore, when the block 9 exists in the linear travelling zone of the endless chain 3 (the upper left zone in FIGS. 1 and 4), the stationary clamp plate 12 is kept under the turn-up attitude having a predetermined angle of inclination with respect to the endless chain 3.

When the block 5 enters the engagement zone between the endless chain 3 and the sprocket 2, the follower roller 8 meshes with the guide plate 16 and is pushed up against the force of the compression coil spring 7, so that the rack 9 of the sliding shaft 6 undergoes displacement in the protruding direction. Then, the pinion 10 rotates clockwise, the clamp portion 11*b* of the movable clamp plate 11 opens with respect to the clamp portion 12*b* of the stationary clamp plate 12, and the stationary clamp plate 12 rotates clockwise round the pin 4 as the center along with the bracket 14 and the block 5 due to the displacement of the follower roller 15 in accordance with the shape of the guide groove 17*a*, and assumes a predetermined inclined attitude.

As the endless chain 3 travels, each block 5 sequentially reaches the intermediate position of the engagement zone between the endless chain 3 and the sprocket 2, and the movable clamp plate 11 of each block 5 is fully open relative to the stationary clamp plate 12 and assumes the erected state directing to the folder unit S.

In the delivery machine of the folder unit of the second embodiment, each delivery fan 18 of the delivery fan wheel 19 rotating integrally with the sprocket 2 rotates in substantial superposition with the stationary clamp plate 12 in the engagement zone between the endless chain 3 and the sprocket 2 in the direction indicated by an arrow A in FIG. 6.

In the first embodiment, therefore, the folded paper sheets sequentially discharged down from the folding machine S as described above move in synchronism with the discharge gap and fail one by one between the movable clamp plate 11 and the stationary clamp plate 12 when each block 5 reaches the intermediate position of the engagement zone between the endless chain 3 and the sprocket 2, and the distal end of the sheet is stopped by the stopper plate 13.

In the second embodiment, the folded paper sheets P fall one by one between each delivery fan 18 and the subsequent delivery fan 18 when each block 5 sequentially reaches the intermediate position of the engagement zone between the endless chain 3 and the sprocket 2, and come between the movable clamp plate 11 and the stationary clamp plate 12 while being guided by the delivery fan 18 and its distal end is stopped by the V-shaped bottom defined by the sides of the delivery fan wheel 19 and the delivery fan 18.

When the block 5 further continues to travel in the engagement zone of the endless chain 3 with the sprocket 2, the follower roller 8 disengages from the guide plate 16 and is no longer restricted. Therefore, it protrudes by the force of the compression coil spring 7 and the sliding shaft 6, that is, the rack 9, undergoes displacement in the backward direction. Then, the pinion 10 rotates counter-clockwise with the movable clamp plate 11, the clamp portion 11*b* of the movable clamp plate 11 closes towards the clamp portion 12*b* of the stationary clamp plate 12, and the folded paper sheet P is clamped by both of the clamp portions 11*b* and 12*b*.

As the travel of the block 5 further proceeds and when the block 5 again enters the linear travelling zone of the endless chain 3 (the lower right zone in FIGS. 1 and 4), the follower roller 15 undergoes displacement in the perpendicular direction to the endless chain 3 in accordance with the shape of the guide groove 17*a* and due to the displacement of the follower roller 15 in accordance with the shape of the guide groove 17*a*, the stationary clamp plate 12 rotates counter-clockwise with the bracket 14 round the pin 4 as the center and assumes, together with the folded paper sheet P, an erected attitude having a predetermined angle of inclination with respect to the endless chain 3.

In the second embodiment, in particular, the guide groove 17*a* is shaped in such a manner that when the clamp portion 12*b* of the stationary clamp plate 12, that is, the folded paper sheet P, rotates from the inclined attitude to the erected attitude, the increase of the angle of inclination of the folded paper sheet P is not greater than the increase of the angle of inclination of the rotating delivery fan 18 with respect to the endless chain 3 until at least the folded paper sheet P in the linear travel reaches a position which is independently of the rotating delivery fan 18.

According to this arrangement, the folded paper sheets P are sequentially transferred to the predetermined position in the linear travel zone (the lower right zone in FIGS. 1 and 4) without interference from the delivery fan 18. When the clamp portion 11*b* of the movable clamp plate 11 is opened with respect to the clamp portion 12*b* of the stationary clamp plate 12 by release means, not shown, (e.g. a guide plate similar to the guide plate 16), in the same way as described already, and the folded paper sheets P are released.

After the folded paper sheets P are thus released, the clamp portion 11*b* of the movable clamp plate 11 is again closed with respect to the clamp portion 12*b* of the stationary clamp plate 12 and again travels in the linear travel zone (the upper left zone in FIGS. 1 and 4).

According to the present invention, the delivery fan wheel can be omitted in the delivery machine. Therefore, the construction can be simplified and the folded paper sheets can be reliably transferred while keeping a predetermined pitch in the same way as in the conventional delivery machine equipped with the delivery fan wheel.

According to the delivery machine of the present invention, the delivery fan wheel, even when it is provided, is coaxially driven with the guide wheel of the endless transfer means. Accordingly, a rotation driving mechanism which has been necessary in the conventional endless transfer means, is complicated in construction and is disposed separately from the delivery fan wheel, can be omitted. Accordingly, the machine can be simplified and the space can be saved.

The rotating directions and the rotating speeds of the delivery fan and the endless transfer means are always in synchronism with one another, and the discharged folded paper sheets are received by the delivery fan and the folded paper sheet folding means and are immediately thereafter supported by the folded paper sheet holding means. In consequence, the folded paper sheets devoid of deviation can be transferred to downstream processing steps and a work efficiency can be improved.

Since the posture control means is provided, the holding means can take the optimal posture at the necessary positions. Therefore, the holding means can reliably hold the folded paper sheets, and the folded paper sheets thus held can be taken out by the delivery fan without any damage. As a result, the loss of paper due to contamination and/or breakage can be eliminated.

While the present invention has been described above with respect to the typical preferred embodiments thereof, it should of course be understood that the present invention should not be limited only to these embodiments but various changes or modifications may be made without departing from the scope of the invention as defined by the appended claims.

I claim:

1. A delivery machine of a folder unit comprising:

endless transfer means disposed to pass in proximity to a downstream side of a discharge portion of a folding machine for discharging folded paper sheets one-by-one, and passing around guide wheels driven in synchronism with the operation of said folding machine;

openable/closable folded paper sheet holding means sequentially disposed on said endless transfer means with predetermined gaps between each said folded paper sheet holding means, wherein each said folded paper sheet holding means comprises a block rotatably supported by said endless transfer means and a sliding shaft protruding through one end of said block, said sliding shaft having a follower roller rotatably fitted onto said protruding end of said sliding shaft, wherein said block contains a coil spring urging said folded paper sheet holding means to a closed state when said spring is in a compressed state by movement of said sliding shaft; and folded paper sheet holding operation means for bringing said folded paper sheet holding means at least from an open state to a closed state in proximity to the downstream side of the discharge portion of said folding machine to allow said folded paper sheet holding means to hold said folded paper sheets discharged sequentially from the discharge portion of said folding machine one-by-one attitude control means for changing the attitude of said folded paper sheet holding means inside a predetermined transfer movement zone of said folded paper sheet holding means, said folded paper sheet holding operation means causing said follower roller to move said sliding shaft and compress said coil spring to urge said folded paper sheet holding means to an open state inside said predetermined transfer movement zone.

2. A delivery of a folder unit according to claim 1, which further includes delivery fans disposed with the same gap as that of said folded paper sheet holding means so that when said endless transfer means passes the proximity of the downstream side of the discharge portion of said folding machine, said folded paper sheet holding means are positioned between said fans adjacent to one another respectively; and delivery fan wheels rotating in such a manner that said delivery fans move with said folded paper sheet holding means.

* * * * *